US007832309B2

(12) United States Patent
Robins

(10) Patent No.: US 7,832,309 B2
(45) Date of Patent: Nov. 16, 2010

(54) DOOR UN-LOCKING TOOL

(76) Inventor: Michael D. Robins, 332 N. Oak Hills Dr., Oak Park, CA (US) 91377

( * ) Notice: Subject to any disclaimer, the term of this patent is extended or adjusted under 35 U.S.C. 154(b) by 92 days.

(21) Appl. No.: 12/191,455

(22) Filed: Aug. 14, 2008

(65) Prior Publication Data

US 2010/0037733 A1 Feb. 18, 2010

(51) Int. Cl.
*E05B 19/20* (2006.01)

(52) U.S. Cl. ..... 81/15.9

(58) Field of Classification Search ..... 81/15.9, 81/6, 9.2, 436, 488; 7/165, 170; 70/394
See application file for complete search history.

(56) References Cited

U.S. PATENT DOCUMENTS

| | | | | | |
|---|---|---|---|---|---|
| 95,964 | A | * | 10/1869 | Zerbe | 7/163 |
| 2,087,423 | A | | 6/1936 | Abrams | |
| 2,196,849 | A | | 5/1937 | Beeg | |
| 2,320,679 | A | | 6/1940 | Taylor | |
| 2,917,954 | A | * | 12/1959 | Capelle | 81/436 |
| 4,437,365 | A | * | 3/1984 | Yaari | 81/436 |
| 4,480,512 | A | * | 11/1984 | Yaari | 81/436 |
| 5,365,811 | A | | 11/1994 | Chi | |
| 5,542,139 | A | * | 8/1996 | Boivin | 7/118 |
| 5,657,543 | A | * | 8/1997 | Collins | 30/367 |
| 5,713,252 | A | | 2/1998 | Iwinski et al. | |
| 5,956,984 | A | | 9/1999 | Hughes | |
| 5,964,132 | A | | 10/1999 | Chen | |
| 6,453,564 | B1 | * | 9/2002 | Foley | 30/359 |
| 6,807,884 | B2 | * | 10/2004 | Sillman | 81/462 |

* cited by examiner

*Primary Examiner*—David B Thomas

(57) ABSTRACT

A door unlocking tool capable of unlocking doors utilizing a lock requiring either a pushrod tip or a flathead tip for disengaging the lock mechanism through an aperture associated with the door knob. The door unlocking tool includes a flat elongated body that defines a first end and a second opposing end. The door unlocking tool also includes a first shaft extending from the first end of the flat elongated body. At the distal end of the first shaft is a pushrod tip. The door unlocking tool also includes a second shaft extending from the second end of the flat elongated body. The second shaft includes a distal end having a flathead tip. The flat elongated body includes an electrical component housing with an illumination device for use in the dark and in an emergency.

9 Claims, 4 Drawing Sheets

DOOR UN-LOCKING TOOL

CROSS-REFERENCE TO RELATED APPLICATIONS

Not Applicable

STATEMENT RE: FEDERALLY SPONSORED RESEARCH/DEVELOPMENT

Not Applicable

BACKGROUND

1. Technical Field of the Invention

The present invention relates generally to door unlocking tools and, more particularly, to a door unlocking tool having a pushrod tip and a flathead tip for unlocking a lock mechanism for a conventional door knob.

2. Description of the Related Art

Conventional door knobs used for bathrooms, bedrooms, and the like, may have a lock integrated therein to thus secure a room and "lock out" others. Such locks as integrated within conventional door knob hardware are also frequently provided with a safeguard feature that enables a person on the other side of the locked door to deactivate the lock and open the door. In its most basic form, the door knob on the opposite side of the knob having the lock mechanism is provided with an aperture into which a flathead type tip or pushrod tip can be inserted which will release the lock mechanism. Such means to deactivate the lock is provided as a safeguard to the extent a door is inadvertently locked, as may occur with small children, people with disabilities, the elderly, carelessness and emergency situations.

Problematic with the safety release mechanism integrated as part of such conventional door locks is the need to have readily accessible the flathead tip or pushrod tip that is meant to be inserted into the door knob to release the door lock. Typically, such device is provided with the original door hardware and becomes lost or otherwise cannot be readily accessed. In such event, makeshift devices, such as bent paper clips, hanger wire and other creatively fashioned alternatives must be utilized. Such alternatives, however, are frustrating, can scratch the door hardware, may not work properly, can jam and break the locking mechanism, and may not be capable of being deployed quickly enough in a given situation (e.g., when a child may inadvertently lock himself in a room). Furthermore, the generic tool that is provided with the door hardware whether it be a pushrod tip or a flathead tip is typically small in size and easily misplaced. The generic tool is used on conventional privacy door knobs typically installed for bathroom doors or bedrooms. These types of conventional door knobs may or may not have a keyed cylinder for unlocking or locking the door knob. Because the generic tool is relatively small in size it is also uncomfortable to use when attempting to unlock a door. The small size makes it hard to get a good grip on the tool and gain leverage when utilizing the generic tool to unlock a door knob. Furthermore, the generic tool is difficult to use in the dark, or in an emergency situation.

Accordingly, there exists a need in the art for a door unlocking tool that can be utilized to readily deactivate the lock mechanism of a conventional door knob. This need is addressed by the present invention, as will be described in more detail below.

BRIEF SUMMARY

The present invention specifically addresses and alleviates the above-identified deficiencies in the art. In this regard, the present invention is directed to a door unlocking tool. The door unlocking tool may be securely and safely fastened to a specified door frame, for quick and easy deployment. The door unlocking tool includes a flat elongated body that defines a first end and a second opposing end. The door unlocking tool also includes a first shaft extending from the first end of the flat elongated body. The first shaft extends away from the flat elongated body of the door unlocking tool. The first shaft also includes a distal end. At the distal end of the first shaft is a pushrod tip. The door unlocking tool also includes a second shaft extending from the second end of the flat elongated body. The second shaft includes a distal end having a flathead tip. As a result, the door unlocking tool includes both a flathead tip and a pushrod tip that may be utilized to unlock a door dependent upon the type of lock that is used on the door. An aspect of the present invention contemplates the first shaft and the second shaft being molded into the flat elongated body of the door unlocking tool. In this regard, the door unlocking tool forms a single unitary piece with two shafts extending from the flat elongated body. Each shaft includes a different tip such as a flathead tip or a pushrod tip. The molded configuration is contemplated such that the first shaft and the second shaft are flat on the inside in a manner thereby preventing a twist, spin, or rotating motion between the flat elongated body and the first or second shaft.

In another embodiment of the present invention, the flat elongated body includes an aperture at the first end. Additionally, the flat elongated body includes an aperture at the second end. The apertures at the first and the second end of the flat elongated body are configured to receive the first shaft and the second shaft. Upon receiving the first shaft and the second shaft in each of the apertures, both shafts are coupled to the flat elongated body. An aspect of the present invention contemplates the ability to remove the shafts from the aperture in order to replace a broken shaft. It is contemplated that a proximal end of the first shaft enters the aperture at the first end of the flat elongated body. Further, the proximal end of the second shaft enters the aperture at the second end of the flat elongated body. Thus, when both the first and the second shaft are coupled to the flat elongated body of the door unlocking tool, the tool is configured to unlock doors requiring either a pushrod tip or a flathead tip. Either the flathead tip or the pushrod tip may be inserted into an aperture of a conventional door knob for releasing the lock mechanism and thereby unlocking the door knob. It is also contemplated that the first end of the elongated body may include the first or the second shaft. Additionally, the second end of the flat elongated body may include the first or the second shaft as well. Thus, the proximal ends of the shaft are not limited to a particular end of the flat elongated body of the door unlocking tool.

In another embodiment of the present invention, the door unlocking tool includes a housing for securing the door unlocking tool. The housing includes opposing ends configured to receive the first shaft and the second shaft of the door unlocking tool. In this respect, at least one opposing end of the housing is shaped to surround or encompass the first end of the flat elongated body including the first shaft. Also, at least one opposing end is shaped to surround or encompass the second end of the flat elongated body including the second shaft. The housing may also include a first surface and a second surface. The first surface is configured to receive the flat elongated body of the door unlocking tool. Another aspect of the present invention contemplates the opposing ends of the housing including a retention clip for securely coupling the door unlocking tool to the housing. One aspect of the present invention contemplates the opposing ends of the housing also including a flange portion for securely coupling the door unlocking tool to the housing. The flange portion of the housing may be shaped to embrace the first and the second shaft of the door unlocking tool. The first surface may also include a slightly elevated portion, such that when the door unlocking tool is securely coupled to the housing the flat elongated body is easy to grip because it is slightly elevated from the rest of the housing. It is also contemplated that the second surface of the housing may have VELCRO™, i.e., hook and loop fastener, affixed to one side. The VELCRO™, i.e., hook and loop fastener, may be used for affixing the housing onto a flat surface. Additionally, double-sided tape may also be used to affix the housing to a flat surface. Other attachment means are also contemplated including magnets, screws, or nails by way of example and not of limitation.

In yet another embodiment, the flat elongated body of the door unlocking tool includes a recess. The recess may be circular in shape. The recess also includes an electrical contact that is coupled with a battery for providing electrical power to an illumination device. Disposed within the recess is an electrical component housing. The electrical component housing includes an illumination device for emitting light in the direction of the flathead tip or the pushrod tip. The electrical component housing is configured to rotate or swivel at least 180 degrees. In one embodiment, the electrical component housing is limited to 180 degree rotation such that a dead stop is maintained at each shaft end to receive the emitted light towards either the pushrod tip or the flathead tip. The electrical component housing may rotate 360 degrees as well. A switch and necessary peripheral electrical components are disposed within the electrical component housing. Applying pressure to the switch causes the illumination device to emit light such that the door unlocking tool may be used in the dark or in an emergency.

The present invention will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

The above description is given by way of example, and not limitation. Given the above disclosure, one skilled in the art could devise variations that are within the scope and spirit of the invention disclosed herein, including various ways of exemplifying the door unlocking tool. Further, the various features of the embodiments disclosed herein can be used alone, or in varying combinations with each other and are not intended to be limited to the specific combination described herein. Thus, the scope of the claims is not to be limited by the illustrated embodiments.

Figures 1, 2:
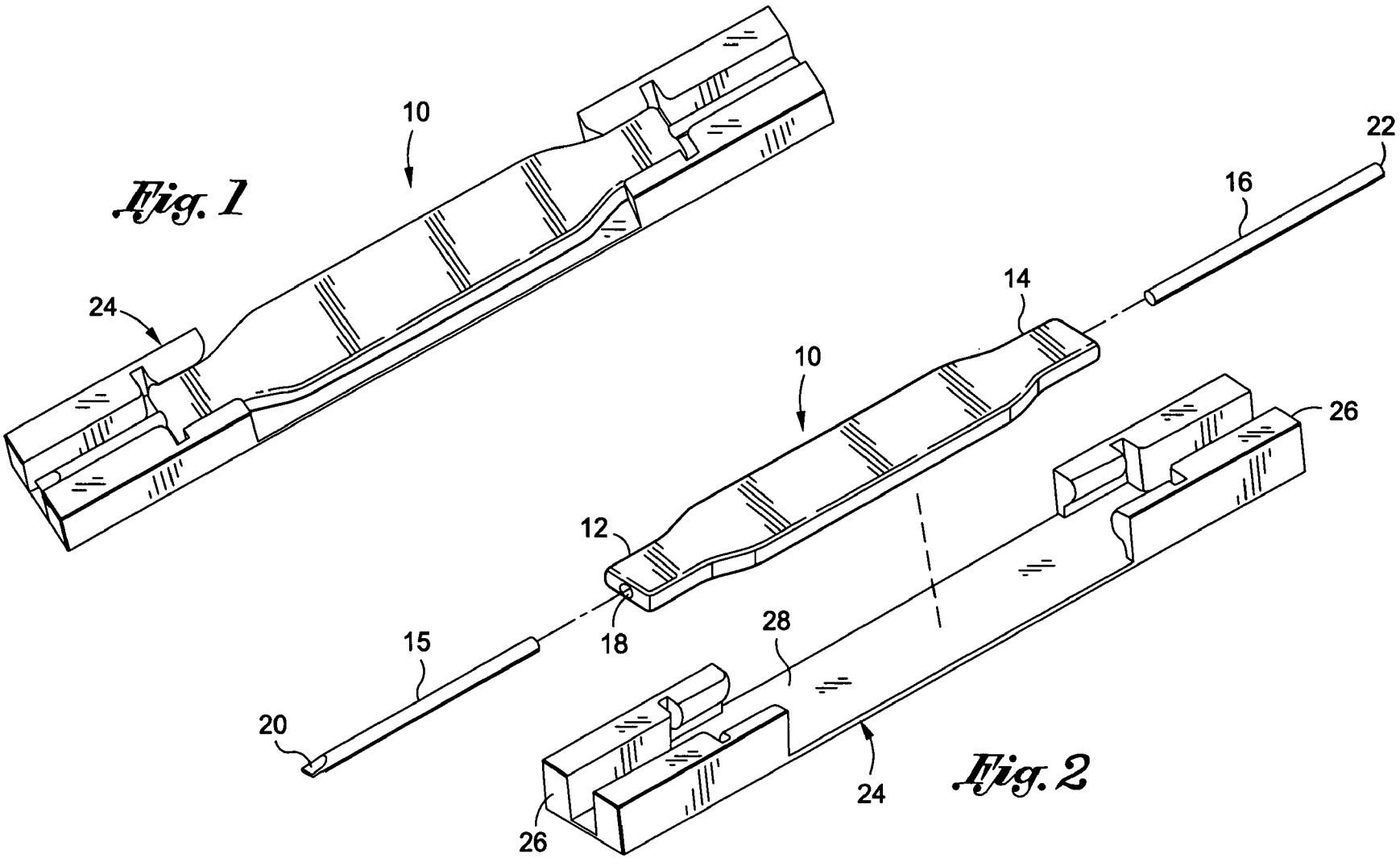
FIG. 1 is a perspective view of a door unlocking tool coupled to a housing constructed in accordance with the present invention.
FIG. 2 is an exploded view of the door unlocking tool, depicting a push rod and a flathead tip of the door unlocking tool as detached from the remainder thereof.

With reference to FIG. 2, a door unlocking tool 10 is provided. The door unlocking tool 10 includes a first opposing end 12 and a second opposing end 14. In one embodiment, the first opposing end 12 and the second opposing end 14 each include an aperture 18. The aperture 18 at each opposing end 12, 14 is configured to receive a shaft. A first shaft 15 may be coupled to the door unlocking tool 10 via the aperture 18 at the first opposing end 12. In this respect, the proximal end of the first shaft 15 is coupled to the flat elongated body of the door unlocking tool 10. A distal end 20 of the first shaft 15 includes a flathead tip. A second shaft 16 may be coupled to the door unlocking tool vial the aperture 18 at the second opposing end 14. The proximal end of the second shaft 16 is coupled to the flat elongated body of the door unlocking tool 10. A distal end 22 of the second shaft 16 includes a pushrod tip. It is also contemplated that the first shaft 15 and the second shaft 16 are interchangeable and the proximal ends of each shaft may be received at either the first end 12 or the second end 14 of the door unlocking tool 10. As will be readily understood, the pushrod tip or the flathead tip is the portion of the door unlocking tool 10 utilized to unlock a door locking mechanism of a conventional door knob. In this regard, the pushrod tip or the flathead tip 14 is inserted into an aperture or cavity associated with the door knob to release the lock mechanism of the door knob.

The elongated body of the door unlocking tool 10 is preferably sized such that it is easily gripped. The combination of the pushrod tip and the flathead tip at the respective distal ends 20, 22 of the first shaft 15 and the second shaft 16 of the door unlocking tool 10 allows for compatibility with numerous door locking mechanisms. Typically, conventional door knob hardware is provided with either the pushrod tip or the flathead tip depending on the type of door knob. However, the shaft with either the pushrod tip or the flathead tip provided with conventional door knob hardware is easily misplaced because of its relatively small size. Furthermore, it is difficult to use a flathead tip to unlock a door knob that may have been designed for a pushrod tip. Conversely, it is difficult to use a pushrod tip to unlock a door knob that may have been designed for a flathead tip. Thus, the door unlocking tool 10 overcomes this problem by providing both the pushrod tip and the flathead tip for unlocking conventional door knobs known as privacy door knobs for locking bathrooms and bedrooms. Additionally, the shaft with either a pushrod tip or flathead tip provided with conventional door knob hardware is difficult to use because of its minimal dimensions. In other words, the shaft or tool is hard to grip. To address such shortcoming, the door unlocking tool 10 of the present invention has a flat elongated body to reduce the chances of misplacing or losing the door unlocking tool 10. The flat elongated body allows a user to grip the door unlocking tool 10 for more comfortable use, greater leverage and greater ease to accurately deploy when required to unlock a conventional door knob with either the flathead tip or the pushrod tip at the distal ends 20, 22 of the first shaft 15 and the second shaft 16 coupled to the flat elongated body. The flat elongated body of the door unlocking tool 10 provides a user with additional leverage by providing the capability of gripping the flat elongated body rather than having to actually hold the shaft having either the flathead tip or the push rod tip.

Still referring to FIG. 2, a housing 24 for securing the door unlocking tool 10 is provided. The housing 24 of the door unlocking tool 10 includes opposing ends 26 configured to receive the first shaft 15 and the second shaft 16 of the door unlocking tool 10. The opposing ends 26 may also be configured to receive a portion of the flat elongated body of the door unlocking tool 10. Each opposing end 26 of the housing 24 is configured to receive a respective opposing end 12, 14 of the door unlocking tool 10. The housing 24 also includes a first surface 28 and a second surface (not shown) opposing the first surface 28. The first surface 28 of the housing 24 is configured to receive the flat elongated body of the door unlocking tool 10. Referring now to FIGS. 1 and 2, the door unlocking tool 10 may be securely coupled to the housing 24, and it is contemplated that the opposing ends 26 of the housing 24 may include a latch (not shown) for securing the door unlocking tool 10 to the housing 24.

Figure 3:
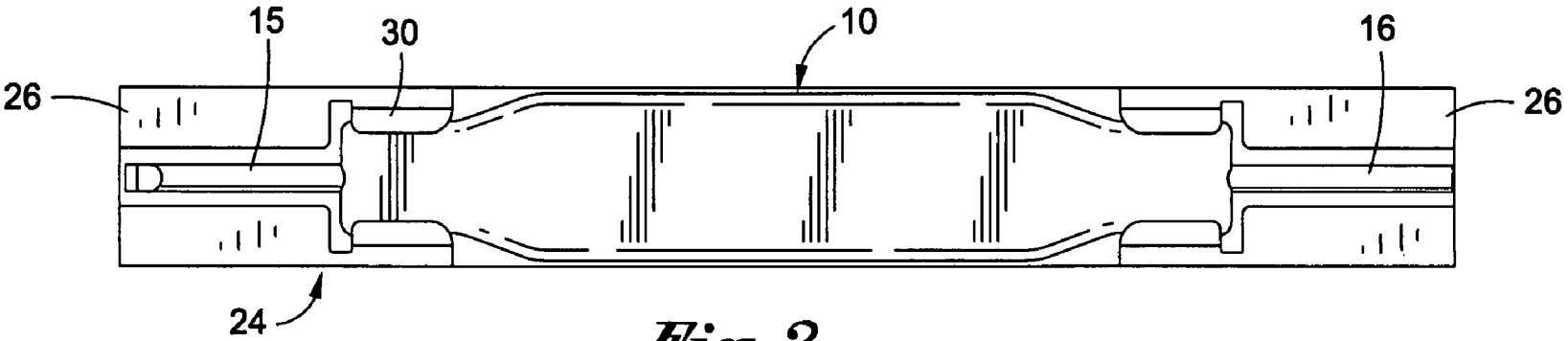
FIG. 3 is an overhead view of the door unlocking tool coupled to the housing.

Referring now to FIG. 3, the door unlocking tool 10 securely coupled to the housing 24 is shown. The opposing ends 26 of the housing 24 are configured to receive the first end 12 and the second end 14 of the door unlocking tool 10, the flathead tip of the first shaft 15, and the pushrod tip of the second shaft 16. The opposing ends 26 of the housing 24 may further include identical flange portions that are shaped such that the housing 24 embraces the shape of the door unlocking tool 10. It is also contemplated that the flange portion of the housing 24 may include a pair of retention clip 30 for securing the door unlocking tool 10 to the housing.

Figure 4:
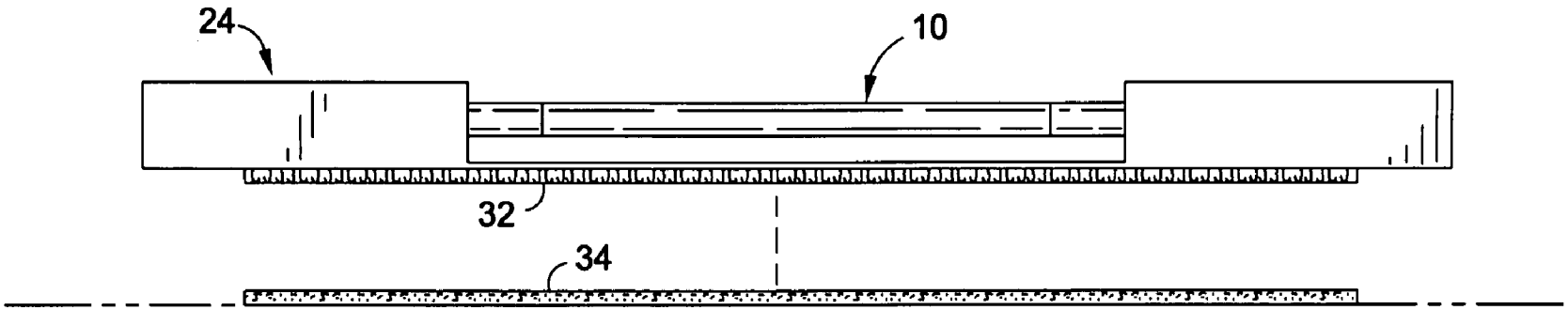
FIG. 4 is a side elevational view of the door unlocking tool coupled to the housing.

Referring now to FIG. 4, the door unlocking tool 10 coupled to the housing 24 is provided. The housing 24 may include a double-sided tape 32 affixed to the second surface of the housing 24. In another embodiment of the present invention, VELCRO™, i.e., hook and loop fastener, or magnets may be used instead of the double-sided tape 32. Other means are contemplated to affix or mount the housing 24 to a flat surface 34, such as dry wall anchors, wood screws, nails and the like. As shown, double-sided tape 32 is used to affix the housing 24 to a flat surface 34 such as a wall. This allows for the door unlocking tool 10 to be stored within the housing 24 near a door where the door unlocking tool 10 may be required to unlock the door knob. The advantage of the housing 24 mounted on a wall near the door is the close proximity of the door unlocking tool 10 when required to unlock a door in the case of emergency. Additionally, if the housing is mounted near the door, it makes misplacing or losing the door unlocking tool 10 unlikely. Further, the door unlocking tool 10 may be coupled to the housing 24 and the housing 24 may be mounted on a wall out of reach of a child.

Figure 5:
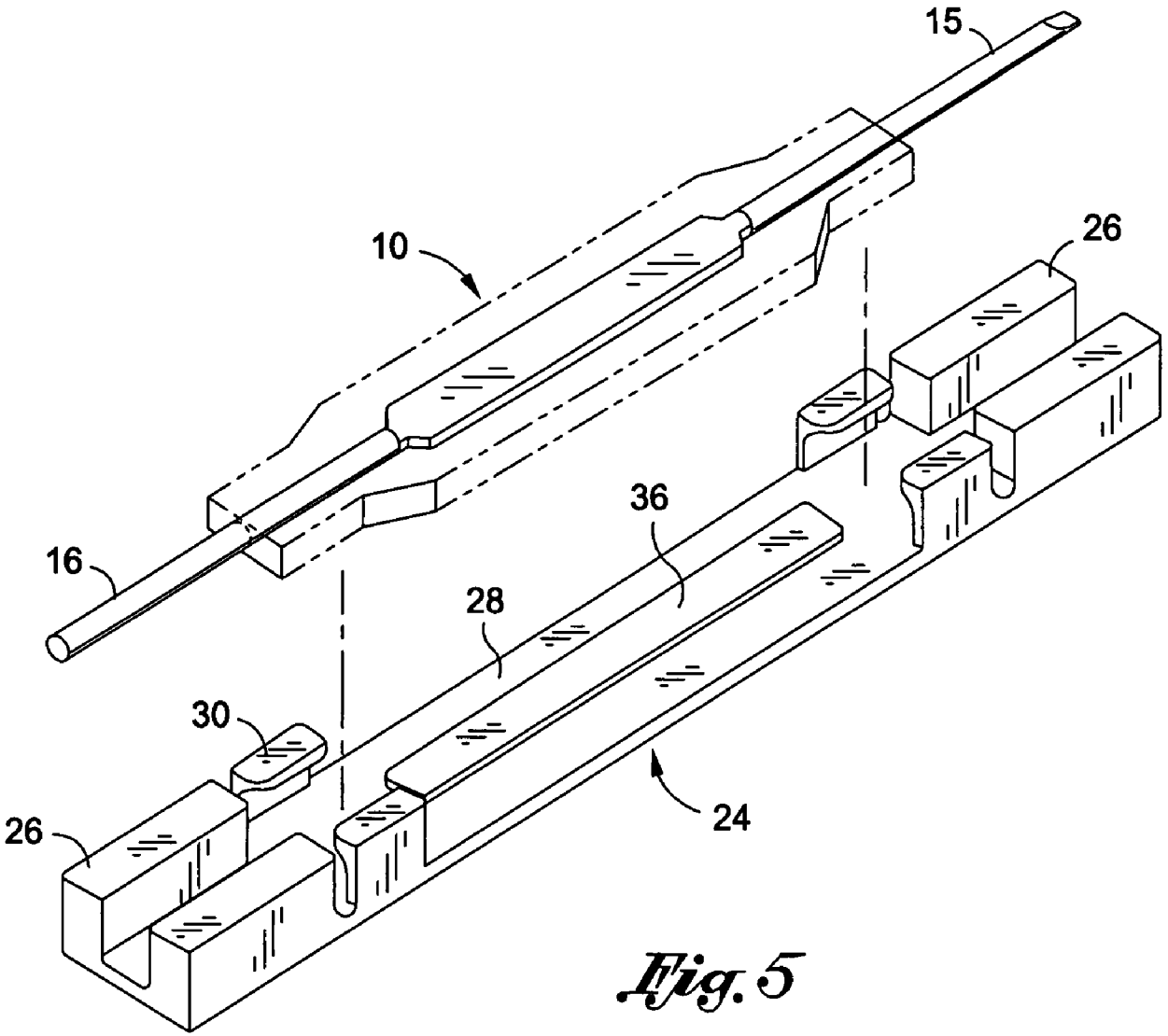
FIG. 5 is a perspective view of the door unlocking tool with a first shaft and a second shaft molded into a flat elongated body of the door unlocking tool.

Referring now to FIG. 5, the door unlocking tool 10 with the first shaft 15 and the second shaft 16 molded into the flat elongated body of the door unlocking tool 10 is provided. In this embodiment of the present invention, it is contemplated that the first shaft 15 and the second shaft 16 are flat along the portion of the shafts 15, 16 that are molded into the flat elongated body of the door unlocking tool 10. This configuration prevent the shafts 15, 16 from spinning and is less resistant to damage when utilizing the door unlocking tool 10 to unlock a door lock mechanism. Additionally, a portion of the first surface 28 of the housing 24 is elevated 36. The elevated 36 portion of the first surface 28 allows for the door unlocking tool 10 to be easily detached or decoupled from the housing 24. In other words, when the door unlocking tool 10 is coupled to the housing 24, the elevated 36 portion of the first surface 28 provides a gap wherein a person may grip the door unlocking tool 10 from underneath the flat elongated body. In this embodiment, the retention clips 30 are shown separate from the opposing ends 26 of the housing 24. The retention clips 30 are configured to hold the door unlocking tool 10 in place when pressed against the first surface 28 of the housing 24. Additionally, when the door unlocking tool 10 lifted from the first surface 28, the retention clips 30 are designed to release the door unlocking tool 10 when the door unlocking tool 10 is lifted with the requisite force.

Figures 6, 7:
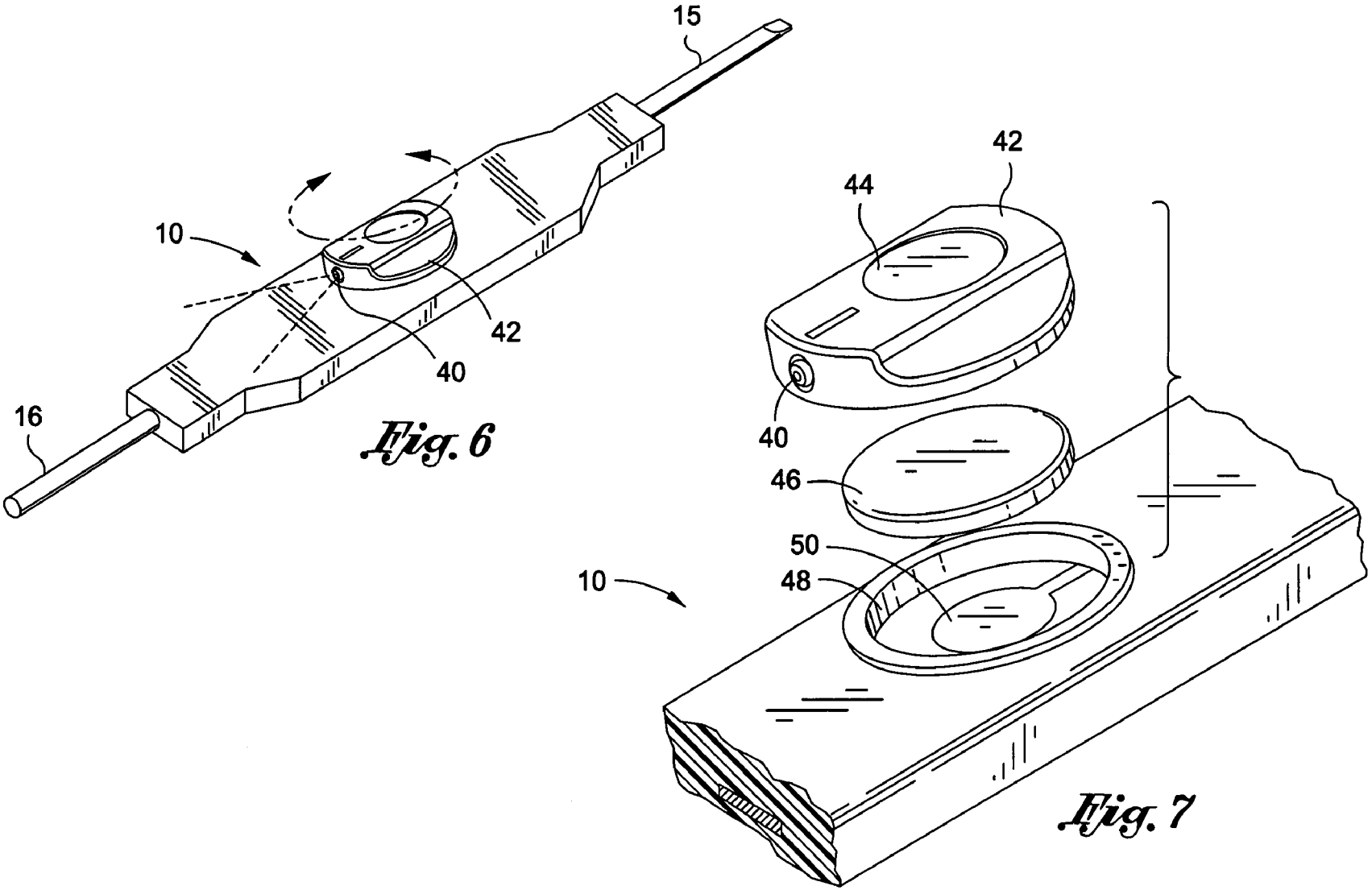
FIG. 6 is a perspective view of the door unlocking tool depicting an electrical component housing and illumination device assembly.
FIG. 7 is an exploded view of the electrical component housing and illumination device assembly.

Referring now to FIGS. 6 and 7, the elongated body of the door unlocking tool 10 includes a circular recess 48. The circular recess 48 includes an electrical contact 50 for coupling with a battery 46 placed inside the circular recess 48. Also disposed within the circular recess 48 and adjacent to the battery 46 is an electrical component housing 42. The electrical component housing 42 includes an illumination device 40 and a switch 44 to power on and off the illumination device 40. The illumination device 40 may include an LED or an incandescent bulb by way of example and not of limitation. The electrical component housing 42 is configured to swivel or rotate within the circular recess 48. The ability to rotate the electrical component housing 42 allows the user of the door unlocking tool 10 to direct the light emitted from the illumination device 40 towards either the pushrod tip 16 or the flathead tip 15. Therefore, the door unlocking tool 10 may be used in emergencies when there is a power outage.

Furthermore, the various embodiments described above are provided by way of illustration only and should not be construed to limit the invention. Those skilled in the art will readily recognize various modifications and changes that may be made to the present invention without following the example embodiments and applications illustrated and described herein, and without departing from the true spirit and scope of the present invention.

What is claimed is:

1. A door unlocking tool, the door unlocking tool comprising:

a flat elongated body having a first end and a second end, the first end and the second end being opposing ends;

a first shaft extending from the first end of the flat elongated body, the first shaft having a distal end, the distal end of the first shaft having a pushrod tip; and a second shaft extending from the second end of the flat elongated body, the second shaft having a distal end, the distal end of the second shaft having a flathead tip;

wherein the first shaft and the second shaft are molded into the flat elongated body to form a single unitary door unlocking tool.

2. A door unlocking tool, the door unlocking tool comprising:

a flat elongated body having a first end and a second end, the first end and the second end being opposing ends;

a first shaft extending from the first end of the flat elongated body, the first shaft having a distal end, the distal end of the first shaft having a pushrod tip;

a second shaft extending from the second end of the flat elongated body, the second shaft having a distal end, the distal end of the second shaft having a flathead tip; and a housing for storing the door unlocking tool, the housing having opposing ends configured to receive the first shaft and the second shaft of the door unlocking tool, the housing having a first surface and a second surface, the first surface being configured to receive the flat elongated body of the door unlocking tool.

3. The door unlocking tool of claim 2, wherein opposing ends of the housing include a retention clip for securely coupling the door unlocking tool to the housing.

4. The door unlocking tool of claim 2, wherein opposing ends of the housing include a flange portion for securely coupling the door unlocking tool to the housing.

5. The door unlocking tool of claim 2, wherein a portion of the first surface of the housing is slightly elevated.

6. The door unlocking tool of claim 2, wherein the second surface of the housing including a hook and loop fastener for mounting the housing to a wall.

7. The door unlocking tool of claim 2, wherein the second surface of the housing having double-sided tape for mounting the housing to a wall.

8. The door unlocking tool of claim 2, wherein the second surface includes a magnet for mounting the housing.

9. A door unlocking tool, the door unlocking tool comprising:

a flat elongated body having a first end and a second end, the first end and the second end being opposing ends;

a first shaft extending from the first end of the flat elongated body, the first shaft having a distal end, the distal end of the first shaft having a pushrod tip;

a second shaft extending from the second end of the flat elongated body, the second shaft having a distal end, the distal end of the second shaft having a flathead tip;

a recess disposed within the flat elongated body, the recess having an electrical contact for coupling to a battery;

an electrical component housing embedded within the recess, the electrical component housing configured to rotate at least 180 degrees;

an illumination device disposed within the electrical component housing; and a switch disposed within the electrical component housing.

* * * * *